United States Patent [19]

Ruumpol

[11] 3,952,240

[45] Apr. 20, 1976

[54] DEVICE FOR REGULATING THE CURRENT IN A LOAD

[75] Inventor: Geurt J. Ruumpol, Wilp, Netherlands

[73] Assignee: Veco Zeefplatenfabriek B.V., Netherlands

[22] Filed: July 8, 1974

[21] Appl. No.: 486,332

[30] Foreign Application Priority Data

July 11, 1973 Netherlands ..... 7309667

[52] U.S. Cl. ..... 323/1; 321/18; 321/24; 323/6; 323/45; 323/51

[51] Int. Cl.[2] ..... G05F 1/14; G05F 1/64

[58] Field of Search ..... 307/252 B, 252 N, 252 T; 323/4, 19, 22 SC, 24, 43.5 R, 43.5 S, 45, 51; 321/16, 18, 24

[56] References Cited

UNITED STATES PATENTS

| | | | |
|---|---|---|---|
| 3,018,431 | 1/1962 | Goldstein | 323/45 |
| 3,379,960 | 4/1968 | May | 323/45 |
| 3,457,494 | 7/1969 | Friend et al. | 323/43.5 R |
| 3,491,283 | 1/1970 | Johnston | 323/24 X |
| 3,504,204 | 3/1970 | Carrive | 323/24 UX |
| 3,562,625 | 2/1971 | Broek | 323/24 X |
| 3,611,117 | 10/1971 | Schneider | 323/45 |
| 3,818,321 | 6/1974 | Willner et al. | 323/43.5 S |

OTHER PUBLICATIONS

Sirassler, Unitrol K1510 & 2510 Pulse Controllers, 8/9–70, pp. 327–333.

*Primary Examiner*—A. D. Pellinen

*Attorney, Agent, or Firm*—Kinzer, Plyer, Dorn & McEachran

[57] ABSTRACT

A device for regulating the current in a load includes a voltage-frequency converter for direct proportionally converting a voltage proportional to the load current into a number of pulses per time unit; a counter and a memory with a corresponding indicator for repetitively storing and displaying a number of pulses counted during a measuring interval; a nominal value control with corresponding indicator, a limit value control, and a comparator and a regulating unit by which the memory contents corresponding to said measuring interval are continuously compared with the lower limit and upper limit value superimposed on the nominal value such that upon exceeding one of these limit values the voltage for the load is adjusted.

3 Claims, 2 Drawing Figures

DEVICE FOR REGULATING THE CURRENT IN A LOAD

The invention relates to a device for regulating the current in a load so as to keep it constant; and particularly relates to a device for maintaining the current in a galvanic bath load constant.

With such loads current variations having a relatively long period can occur as a result of for example bath-agitation, load variation, non-constant distance of the roller in the bath to the anode, and such. The measuring time has to be adjusted to the period so as to have a good quiet regulating control and therefore has to be selected rather large. An additional advantage is that reading-off and adjusting the device can be done more easily, for example by unskilled personnel.

It is therefore an object of the invention to provide a device of the above mentioned type, which device comprises a voltage-frequency converter for direct proportionally converting a voltage proportional to the load current into a number of pulses per time unit; a counter and a memory with a corresponding indicator for repetitively storing and displaying the number of pulses counted during a measuring interval; a control with a corresponding indicator for setting a nominal value, a control for setting a limit value, a comparator and a regulating unit, by which the memory contents corresponding to the measuring interval are continuously compared with the lower and upper limit value superimposed on the nominal value such that upon exceeding one of these limit values the voltage for the load is adjusted.

An advantageous embodiment of the invention is characterized by a series measuring shunt and measuring amplifier for receiving a voltage proportional to the load current, which voltage after amplification is supplied to the voltage-frequency converter; a measuring gate inserted before the counter and a clock pulse generator for setting the measuring interval in the measuring gate and for setting and resetting the memory and the counter; the regulating unit including a relay amplifier, an up-relay and a down-relay and a servomotor.

A further advantageous embodiment of the invention is characterized in that the memory applies a 16 bit BCD-signal to its corresponding indicator and the comparator; that an adding circuit and a subtracting circuit is provided for adding and subtracting the 8 bit BCD signal to and from respectively the 16 bit BCD signal of the control for setting the nominal value, the output signals of the adding circuit and the subtracting circuit being applied to the comparator.

Figure 1:
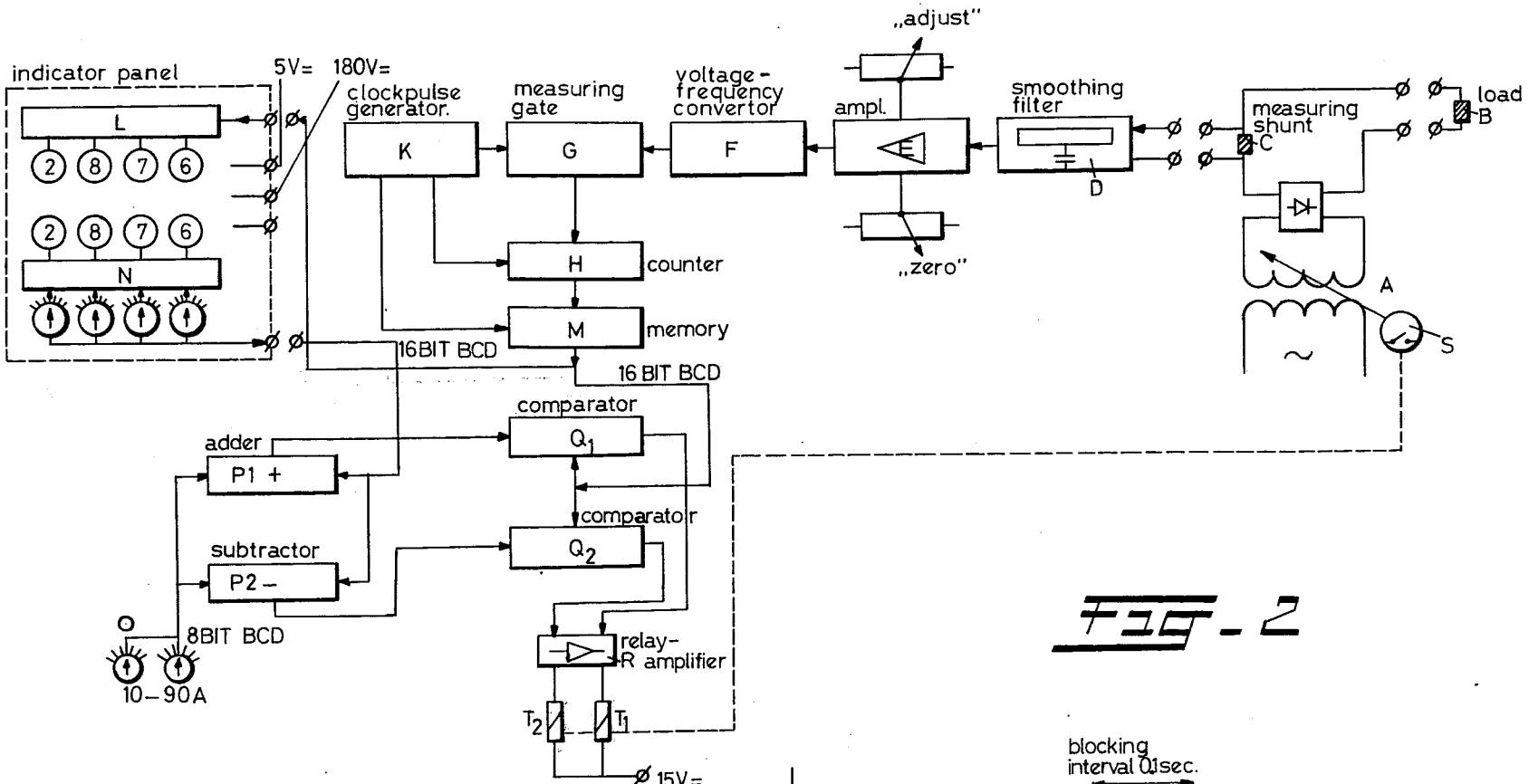
Figure 2:
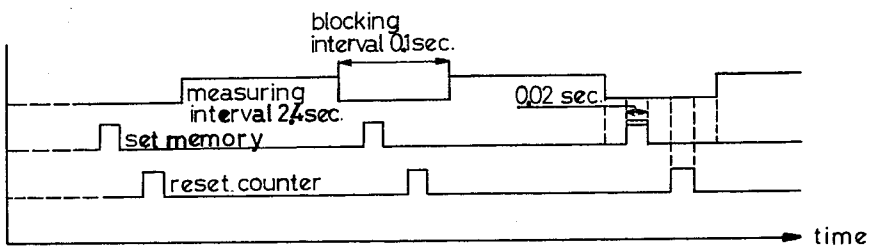

The invention will now be explained on the basis of an example of an embodiment with reference to the drawings, in which:

FIG. 1 shows the block diagram of an embodiment of the device according to the invention; and FIG. 2 shows a time diagram a plurality of signals occurring in the device of FIG. 1.

The regulating transformer A of FIG. 1 which is being fed with alternating current, supplies a direct current with the aid of rectifier cells to a circuit in which a measuring shunt C is inserted besides a load B.

The voltage difference of the measuring shunt C is applied via a smoothing filter D to a measuring amplifier E, the zero state and the amplification of which can be adjusted separately. The outputted voltage difference is applied to a voltage-frequency converter F and is converted into a pulse train, the number of pulses of which per time unit is directly proportional to the voltage difference. During the measuring interval the pulses are applied to the counter H via the measuring gate G. The gate time of the measuring gate G is controlled by a clock pulse generator K. When the measuring gate G is blocked, the contents of the counter H are transferred to the memory M. Subsequently, the clock pulse generator K takes care that the counter is reset and that the cycle can start anew. The memory M is also reset by the clock pulse generator.

The memory M supplies a 16 bit binary coded-decimal signal, by which the contents of this memory are made visible in the indicator panel by means of a plurality of indicator tubes L.

A corresponding number of indicator tubes N is available in this panel, by which the operator can display a nominal value setting for example by means of switches.

The 16 bit BCD signal of the nominal value setting and the 8 bit BCD signal of the limit value setting are applied to an adding circuit P1 and to a subtracting circuit P2. This limit value superimposed on the nominal value defines a regulating interval, for example from 10 up to 90 amperes, in which the current of the load has to be regulated.

Thus P1 is a 4 decades or 16 bit BCD add and P2 is a 4 decades or 16 bit BCD subtractor. In the adder P1, the preset nominal value setting of the adjusting portion, which consists of the indicator tubes N and the corresponding switches, is increased by the 8 bit BCD limit value setting of the control O. In the subtractor P2 similarly, the preset nominal value setting of the adjusting portion of the indicator panel is decreased by the limit value setting of the control O.

The output signals of the adding and subtracting circuits are applied to the Q1-portion and the Q2-portion respectively of the comparator Q1/Q2, to which the 16 bit BCD-signal of the memory M is also applied. In the Q1-portion of the comparator the contents of the memory M are continuously compared with the contents of Q1, i.e. with the 16 bit BCD signal of the nominal value increased by the limit value of P1. If M is smaller than or equal to Q1 the regulating action is not set into operation. If M, however, is larger than Q1, a voltage is supplied via the relay amplifier R. The relay T1 is excited by which the servomotor S then controls the regulating transformer A to decrease the voltage.

In the Q2-portion of the comparator the contents of M are compared with the contents of Q2. If M is larger than or equals Q2, the regulating action is not set into operation. But if M is smaller than Q2, a voltage is supplied via the relay amplifier R. The relay T2 is excited by which the servomotor S controls the regulating transformer A to increase the voltage.

Thus both Q1 and Q2 are 4 decades or 16 bit BCD magnitude comparators. In the comparator Q1, the measuring values $m$ stored in the memory M are compared with the sum of the nominal value $n$ and limit value $o$. If $m$ is less than or equal to $n + o$ there is no output signal, but if $m$ is greater than $n + o$ there is a control signal which via the amplifier R excites the relay T1.

In the comparator Q2, the measuring value $m$ stored in the memory M is compared with the difference between the nominal value $n$ and the limit value $o$. If m is greater than or equal to $n - o$ there is no output signal, but if $m$ is less than $n - o$ there is a control signal which via the amplifier R excites the relay T2.

FIG. 2 shows a plurality of signals which occur in the device according to FIG. 1. The measuring interval of the measuring gate G can be adjusted, for example, to 2.4 seconds. A blocking interval of 0.1 second can occur every time between the measuring intervals of the measuring gate. In this blocking interval the contents of the counter H are transferred to the memory M, and the memory and the counter are set and reset respectively.

What is claimed is:

1. A device for regulating the current in a load comprising a voltage-frequency converter for direct proportionally converting a voltage proportional to the load current into a number of pulses per time unit; said pulses being applied to a counter and a memory with a corresponding indicator for repetitively storing and displaying a number of pulses counted during a measuring interval; a nominal value control with corresponding indicator for setting and displaying a nominal value, a limit value control for setting a limit value, adding and subtracting circuits connected to the nominal value control and limit value control for determining the sum of and difference between the nominal value and control value, a comparator connected to the adding and subtracting circuits and the memory and a regulating unit connected to the comparator, in which comparator the memory contents corresponding to said measuring interval are continuously compared with said sum and difference such that upon exceeding the sum or falling short of the difference a control signal is sent from the comparator to the regulating unit to adjust the voltage for the load.

2. A device according to claim 1, characterized by a series measuring shunt and measuring amplifier interposed between the load and voltage frequency converter for receiving a voltage proportional to the load current, which voltage after amplification is applied to the voltage-frequency converter; a measuring gate interposed between the voltage frequency converter and the counter and a clock pulse generator for setting the measuring interval in the measuring gate and for setting and resetting the memory and the counter; the regulating unit including a relay amplifier, an up-relay and a down-relay and a servo-motor.

3. A device according to claim 1, characterized in that the memory applies a 16 bit BCD signal to its corresponding indicator and the comparator; that the adding circuit and subtracting circuit are provided for adding and subtracting an 8 bit BCD signal of the limit value control to and from respectively a 16 bit BCD signal of the nominal value control, the output signals of the adding circuit and the subtracting circuit being applied to the comparator for comparison with said 16 bit BCD signal of the memory.

* * * * *